US007090202B1

(12) United States Patent
O'Brien

(10) Patent No.: US 7,090,202 B1
(45) Date of Patent: Aug. 15, 2006

(54) FENCE AND METHOD OF PRODUCING SUCH

(75) Inventor: James Richard O'Brien, Alpharetta, GA (US)

(73) Assignee: XFM, Inc., Alpharetta, GA (US)

( * ) Notice: Subject to any disclaimer, the term of this patent is extended or adjusted under 35 U.S.C. 154(b) by 0 days.

(21) Appl. No.: 10/027,203

(22) Filed: Dec. 26, 2001

Related U.S. Application Data

(60) Provisional application No. 60/258,220, filed on Dec. 26, 2000.

(51) Int. Cl.
*E04H 17/14* (2006.01)

(52) U.S. Cl. ..... 256/67; 265/22; 265/24; 265/60; 265/73

(58) Field of Classification Search ..... 256/67, 256/60, 65.03, 73, 24, 27, 22
See application file for complete search history.

(56) References Cited

U.S. PATENT DOCUMENTS

| | | | | | |
|---|---|---|---|---|---|
| 1,757,686 | A | * | 5/1930 | Rosenbaum | 256/72 |
| 1,796,175 | A | * | 3/1931 | Winston | 256/22 |
| 3,456,921 | A | * | 7/1969 | Hinkle | 256/22 |
| 4,074,893 | A | * | 2/1978 | Coltrin | 256/65.05 |
| 4,898,365 | A | * | 2/1990 | Conner et al. | 256/22 |
| 5,415,380 | A | * | 5/1995 | Sharp | 256/22 |
| 5,544,866 | A | * | 8/1996 | Dye | 256/65.07 |
| 5,645,271 | A | * | 7/1997 | Nunez | 256/65.07 |
| 5,971,365 | A | * | 10/1999 | Pigott et al. | 256/65.08 |

FOREIGN PATENT DOCUMENTS

| | | | | |
|---|---|---|---|---|
| AU | 9944656 | A | * | 3/2000 |
| DE | 19648179 | A1 | * | 4/1998 |
| FR | 1061340 | | * | 4/1954 |
| FR | 2799671 | A1 | * | 4/2001 |
| GB | 13648885 | A | * | 6/1974 |
| GB | 2299100 | A | * | 9/1996 |

OTHER PUBLICATIONS

"Ornamental Iron Fencing Styles", Freedom Fence & Construction Company, Inc., 241 North 10th, Suite 2, Sacramento, CA 95814 (2000, 2001) (printed from www.freedomfenceco.com on Apr. 23, 2003).

(Continued)

*Primary Examiner*—Daniel P. Stodola
*Assistant Examiner*—Ernesto Garcia
(74) *Attorney, Agent, or Firm*—Baker, Donelson, Bearman, Caldwell & Berkowitz, PC

(57) ABSTRACT

A fence panel that tracks a sloped terrain surface, in which a pair of spaced-apart rails each have a first longitudinal edge and an opposing second longitudinal edge on a side of the rail, and a plurality of pickets having first pickets and at least two second pickets disposed spaced apart on the side of the rails, with the first pickets attached by a fastener only between the picket and the first longitudinal edge of the respective rail and the second pickets attached by a fastener only between the picket and the second longitudinal edge of the respective rail, so that the rails do not roll away from the pickets when racking the fence panel by moving the opposing ends of the rails in vertically opposite directions to conform the slope of the fence panel to the terrain surface. A method of making a fence panel is disclosed.

18 Claims, 4 Drawing Sheets

OTHER PUBLICATIONS

"Slope/Grade Changes", Response to FAQ, Hoover Fence Co., Hoover Enterprises, Inc., 5531 McClintlocksburg Road, Newtown Falls, Ohio 44444 (1995-2001) (printed from www.hooverfence.com on Apr. 23, 2003).

"Racking And Stair Stepping Panels", (1997); Hoover Fence Co., Hoover Enterprises, Inc., 5531 McClintlocksburg Road, Newtown Falls, Ohio 44444 (1995-2001) (printed from www.hooverfence.com on Apr. 23, 2003).

* cited by examiner

FENCE AND METHOD OF PRODUCING SUCH

The present application is a continuation-in-part of co-pending provisional application Ser. No. 60/258,220, filed Dec. 26, 2000.

TECHNICAL FIELD

This invention relates to fencing and methods of producing fencing, and more particularly, the present invention relates to rail and picket fencing that is selectively angled on site to conform the slope of the fencing to the slope of an underlying terrain.

BACKGROUND OF THE INVENTION

Fencing has existed for many years. In particular, wrought iron fencing or the like has been developed to produce a more decorative type of fencing. This type of fencing comprises a series of vertical pickets which are attached to horizontal rails. In some known types of wrought iron fencing, the rails have holes through which the pickets extend. Screws connect the pickets attach to the rails with screws or by welding.

In the past, wrought iron fencing erected upon a sloping terrain was typically produced on site by planting several spaced-apart vertical posts, mounting the rails to the posts at an angle generally parallel to the sloping terrain, and mounting the vertical pickets to the rails. This method of producing fencing is time consuming and inefficient.

To meet the need for providing fencing that conforms to the slop of the terrain, wrought iron fencing has been custom manufactured. The terrain to be fenced is measured to determine the slopes. Plats are marked, and custom fence sections manufactured. These have to be labeled in order to track the location and sequence during installation. However, during the manufacturing, the terrain may have changed. For example, a pool area to be fenced may change due to subterranean problems such as rocks and the like uncovered during installation of the pool. The area to be fenced thus may change or be re-graded. This results in re-work or scrap sections of fencing, which increases the costs of the fencing.

Recently, fencing has been produced off-site wherein the rails and pickets are all mounted together to form a panel. The pickets are welded to the rails with the use of a top weld between the picket and the top rail and a bottom weld between the picket and the bottom edge of the bottom rail, as shown in prior art FIG. 6. (In other embodiments, the pickets and the rails are secured with screws).

The fence panel is then transported to the erection site and installed. To track or conform to the slope of the terrain, the panel is shifted (or in the term of the art, "racked") so that the pickets remain substantially vertical and rails are oriented substantially parallel to the sloping terrain. The fence panel is racked so that the rails are allowed to be reoriented with respect to the pickets thereon through the use of a mild steel weld (or screws) which allow flexing of the weld. While this shifting of the fence panel has worked fairly well when shifting only a small amount or a few degrees, there is a problem with more significant changes in the angle of the rails relative to the pickets. When the panel is shifted to a large degree, the rails tend to roll or rotate on the unwelded side and thereby partially separate themselves from the pickets. The rails and pickets there are not square to each other and the fence has unsatisfactory gaps at the connections between the rails and the pickets. The gaps weaken the fence panel and are unsightly.

Accordingly, it is seen that a need remains for a fencing panel that can be produced off-site and shifted during assembly on-site without causing the rails to separate from the pickets. It is to the provision of such that the present invention is primarily directed.

BRIEF DESCRIPTION OF THE PRESENT INVENTION

The present invention meets the need in the art by providing a fence panel that readily adjusts to conform substantially to a slope of a terrain during installation of the fence panel. The fence panel tracks a sloped grade of a portion of a terrain surface for attaching to adjacent ones of the fence panel to define an elongate length of fencing along the terrain surface, comprises a first rail disposed parallel and spaced-apart from a second rail, which rails define a longitudinal length of a fence panel. Each rail defines on a side opposing spaced-apart first and second side edges, with the rails disposed at an angle relative to horizontal. A plurality of spaced-apart pickets define a pair of second pickets and a plurality of first pickets. The pickets are disposed substantially perpendicular to horizontal and attach to the side of the rails with fasteners such that each of the first pickets attach to the rails only by a fastener between the first side edge and the respective first picket and the second pickets attach to the rails only by a fastener between the second side edge and the respective second picket. The fence panel, being racked by moving opposing ends of the panel in opposing directions transverse to the longitudinal axis of the rails, conforms a slope of the rails substantially to the slope of the portion of the terrain by changing the angle between the pickets and the rails while the pickets substantially perpendicular to horizontal without the rails rolling away front the first and second pickets.

In another aspect, the present invention provides a method of making a fence panel for tracking a sloped grade during installation of a fence over a terrain, comprising the steps of:

(a) disposing a pair of rails parallel and spaced-apart at an angle to a horizontal plane to define a longitudinal length of a fence panel, the rails defining opposing first and second side edges spaced-apart relative to the horizontal plane;

(b) attaching a plurality of first pickets to a side of the rails disposed substantially perpendicular to the horizontal plane with fasteners only between the first pickets and the first side edge of the respective rail; and (c) attaching at least two second pickets to the side of the respective rail disposed substantially perpendicular to the horizontal plane by with fasteners only between the second pickets and the second side edge of the respective rail whereby the fence panel, being racked by moving opposing ends of the fence panel in opposing directions transverse to the longitudinal axis of the rails, conforms a slope of the rails substantially to a slope of a portion of the terrain by changing the angle between the first and second pickets and the rails while the first and second pickets remain substantially perpendicular to horizontal without the rails rolling away from the first and second pickets.

Objects, features, and advantages of the present invention will become apparent from a reading of the following detailed description of the invention and claims in view of the appended drawings.

DETAILED DESCRIPTION OF THE PREFERRED EMBODIMENTS

Figure 1:
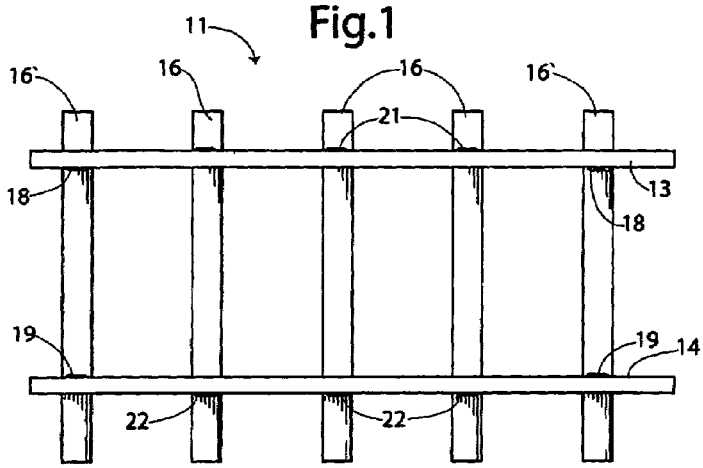
FIG. 1 is a rear side view of a fence panel embodying principles of the invention in a preferred form.
Figure 2:
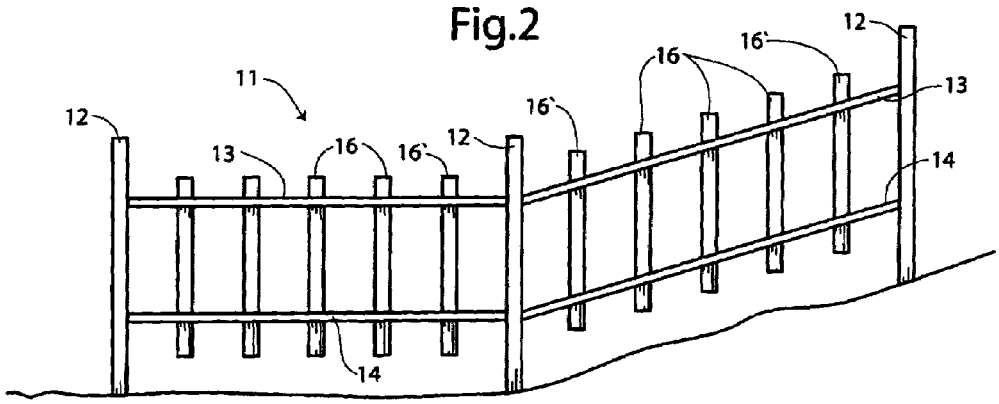
FIG. 2 is a side view of the fence of FIG. 1, shown erected upon a sloping terrain.

Referring now in more detail to the drawings, in which like numerals indicate like parts throughout the several views, FIG. 1 illustrates a fence 10 embodying principles of the invention in a preferred form. The fence 10 has a series of panels or sections 11 mounted to a series of posts 12. Each section 11 includes a top rail 13, a bottom rail 14, and a series of pickets 16 mounted to the top rail 13 and the bottom rail 14. Each rail 13, 14 defines a lower side edge 25 and an upper side edge 26 which side edges abut against a face of the pickets 16 (see FIG. 3), for a purpose discussed below. In the illustrated embodiment, the rails and the pickets are metal.

The outermost pickets 16' and 16' of each section 11 mount or fasten to the top rail 13 with a lower, flexible, mild steel weld 18 extending along the lower edge 25 of the top rail 13, and mount to the bottom rail 14 with an upper, flexible, mild steel weld 19 extending along the upper edge 26 of the bottom rail 14. The outer pickets 16' thus connect to the rails 13, 14 with opposing welds 18, 19 on the opposing side faces 25, 26.

Each inner picket 16 of each section 11 mounts to the top rail 13 with an upper, flexible, mild steel weld 21 extending along the upper edge 26 of the top rail 13, and mount to the bottom rail 14 with a lower, flexible, mild steel weld 22 extending along the lower edge 25 of the bottom rail 14.

It has been found that a section 11 of fence manufactured in this manner may be shifted up to approximately 30 degrees, with respect to the angle between the pickets and the rails, although about 20 degrees is the preferable limit, without causing the rails 13 and 14 to twist or rotate and thereby separate from the pickets 16.

Figure 3:
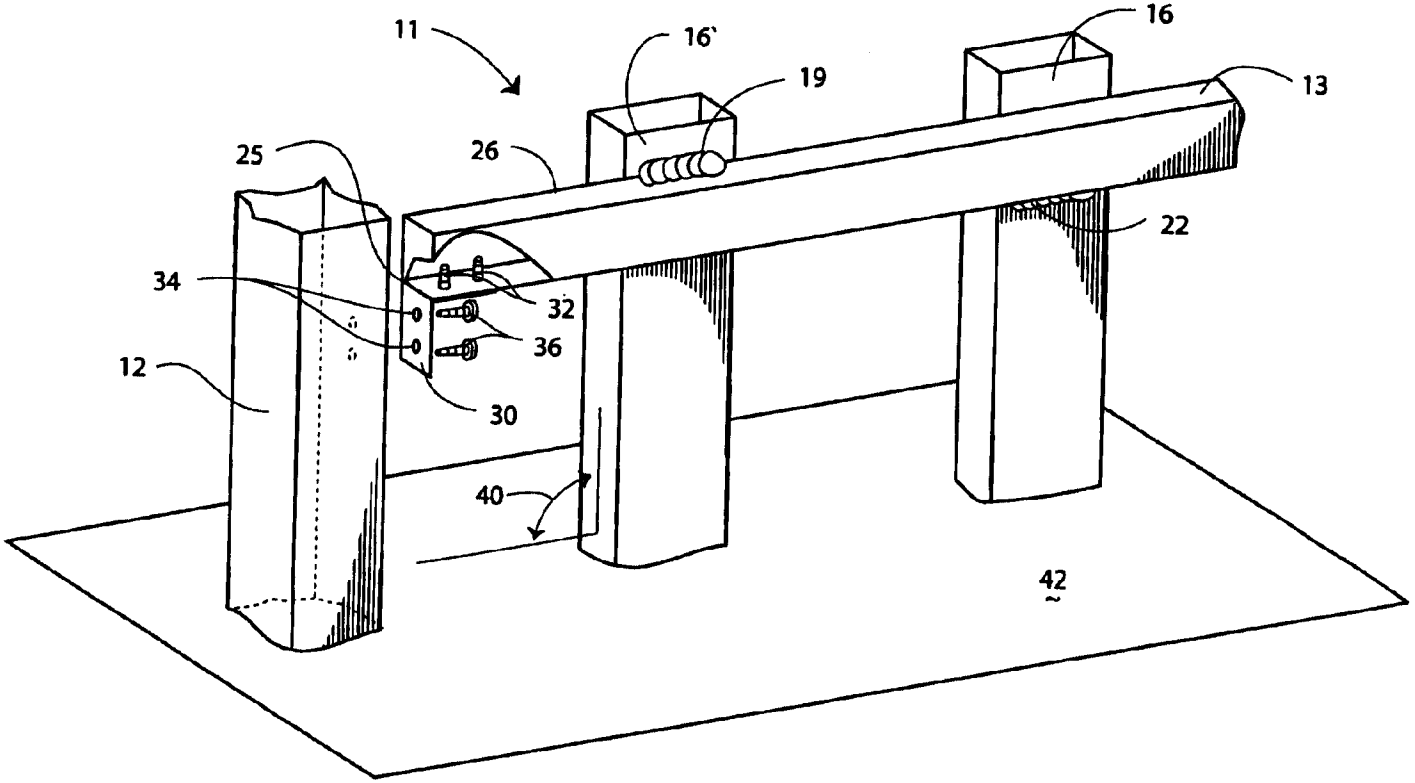
FIG. 3 is a detailed perspective view of an embodiment of the present invention prior to installation.

FIG. 3 is a detailed perspective view of an embodiment of the fence section 11 of the present invention prior to installation. An angle member 30 with angled legs attaches such as with screws 32 to distal ends of the rails 13, 14. A free leg defines holes 34 that receive screws 36 for securing the fence section 11 to fence posts 12. Another of the fence sections 11 readily connects to the post 12 to for a continuous length of fence 10.

In the embodiment illustrated in FIG. 3, it is to be appreciated that the welds securing the rails and pickets (welds 18, 19 and 21, 22 are switched), but maintain their opposing nature which facilitates the capability of the fence section 11 to be reoriented during installation. In this illustrated embodiment, the outer picket 16' connects to the upper rail 13 with the weld 19 on the upper side edge 26 and the inner pickets 16 connect by welds 22 at the lower side edge 25. Not illustrated is the opposing rail 14 in which the orientation of the welds 18, 19 and 21, 22 connecting the pickets 16, 16' to the rail 14 is likewise changed to maintain the opposing relations. The lower rail 14 in this embodiment connects to the outer pickets 16' with the weld 18 on the lower side edge 25 and the inner pickets 16 connect with the weld 21 on the upper side edge 26. The pickets 16, 16' are disposed substantially perpendicular 40 to a horizontal plane 42 (such as a terrain surface with no slope). The rails 13, 14 are disposed parallel to the horizontal plane 42, or thus orientated at 0 degrees elevation.

Figure 4:
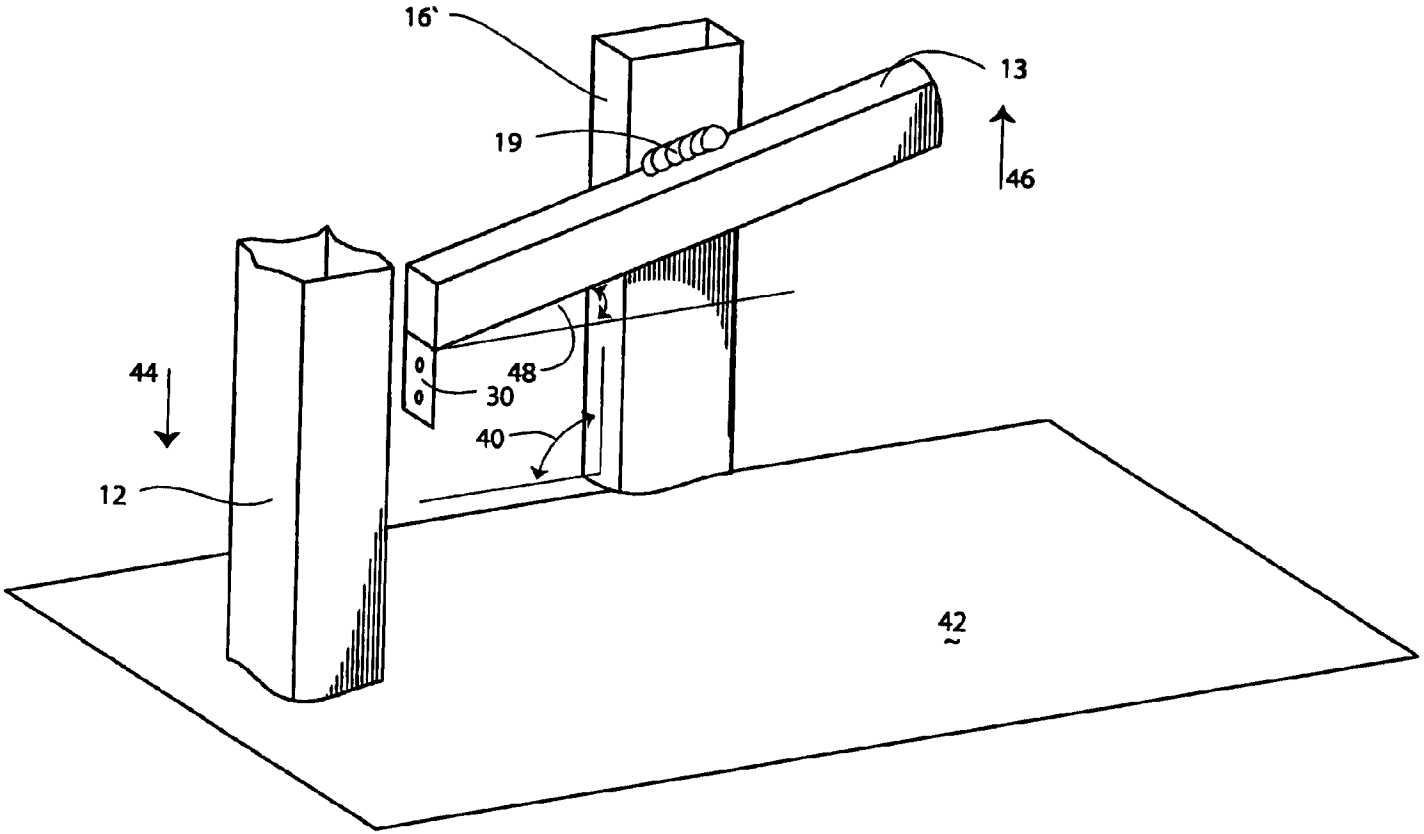
FIG. 4 is a detailed perspective view of the embodiment illustrated in FIG. 3 showing the racking of the fence panel during installation.

FIG. 4 is a detailed perspective view of the embodiment illustrated in FIG. 3 showing the racking of the fence panel 11 during installation. The opposing ends of the fence section 11 are moved in opposing relative directions transverse to the longitudinal axis of the rails, as indicated by the arrows 44, 46. The mild welds 18, 19, and 21, 22 allow the pickets 16, 16' to flexibly move relative to the rails 13, 14. This disposes the rails 13, 14 at an angle 48 of elevation relative to the horizontal plane 42 conforming substantially to the slope of the terrain, while the pickets 16, 16' remain generally substantially perpendicular to the horizontal plane 42 (or terrain). Generally, the angle 48 is limited to about 20 degrees of flexible re-orientating of the rails and the pickets, although may be as high as about 30 degrees.

To provide a greater variance in fencing, each section 11 may also be manufactured at a pre-selected angle between the pickets 16 and the rails 13 and 14. As such, a fencing having a pre-selected angle of 30 degrees may be shifted a maximum of 30 degrees so as to provide fencing which may be mounted to a terrain angle having a range of between 0 degrees and 60 degrees from horizontal. It has been found however, that about 20 degrees is the preferable maximum. At about 25 degrees of change, the pickets 16, 16' begin to have visually detectable appearances of slight distortion, as the distance between the distal ends of the vertical pickets changes due to the racking. This change in span, while slight, is induced by the different axis of rotation of the welds 18, 19 for the outer pickets 16' than for the welds 21, 22 for the inner pickets 16. Accordingly, a series of fence sections 11 having the rails 13, 14 at an angle selected from the group of 0 degrees, 20 degrees, 40 degrees, and 60 degrees (relative to a horizontal plane) appropriately allows these sections to be placed in fences 10 on terrain of 0 to about 80 degrees.

In the illustrated embodiment, the pickets 16, 16' are spaced uniformly apart. In an alternate embodiment, the pickets 16, 16' have different spans which may contribute different ornamental appearances.

Figure 5:
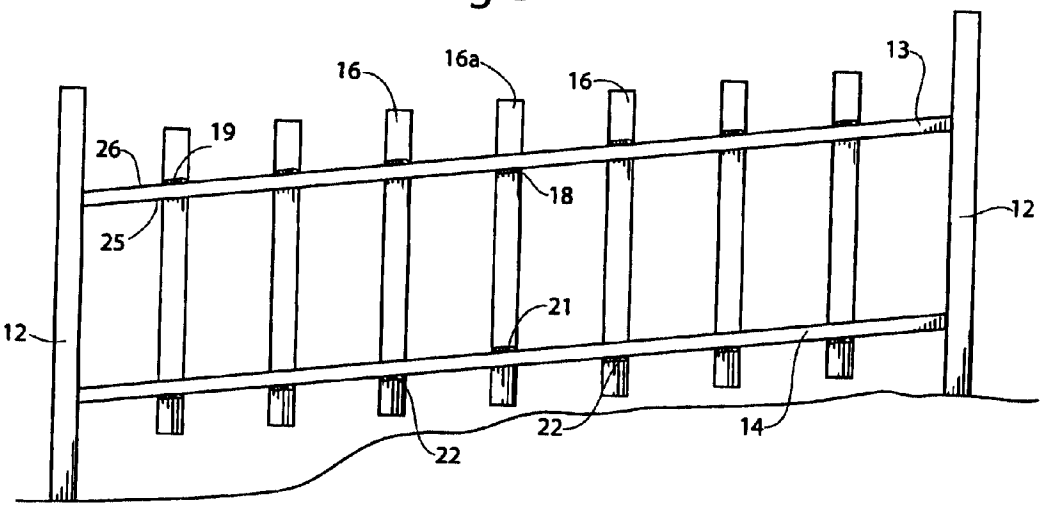
FIG. 5 is a rear side view of a fence section according to the present invention with one picket having reversed fastening from the other pickets in the fence section.
Figure 6:
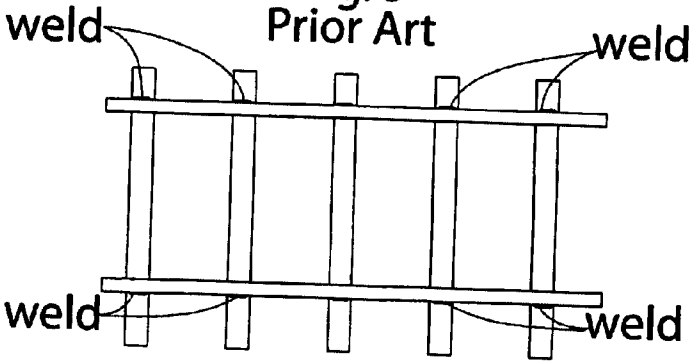
Fig. 6 Prior Art
FIG. 6 is a side view of a fence panel of the prior art.

While the disclosed embodiment has the fastening welds reversed as to the outer pickets 16' from the fastening welds for the inner pickets 16, the racking capability of the present invention will also be found in embodiments in which the pickets with the reversed fastening are spaced inwardly from the outermost pickets. Preferably, two pickets spaced-apart have the reversed fastening from the other pickets in the fence section. It is believed however that limited degrees of racking would be available in an embodiment having at least one picket with reversed fastening to the rails. For example, FIG. 5 is a rear side view of a fence section according to the present invention with one picket **16*a*** having reversed fastening from the other pickets in the fence section.

Further, while the disclosed fence section is manufactured of wrought iron, the picket and rail racking fence section can be readily assembled with pickets and rails of other materials, including plastic, wood, or other materials, given that the rails fasten to the pickets with fasteners to fix a connection therebetween with at least one but preferably two pickets having reversed fastening. Fasteners other than welds can be used to fix the connection between the rails and the pickets. For example, in an embodiment with wood members, the fastening is accomplished with screws at the side edges of the rails as disclosed herein.

While this invention has been described in detail with particular references to the preferred embodiments thereof, it should be understood that many modifications, additions and deletions, in addition to those expressly recited, may be made thereto without departure from the spirit and scope of the invention.

What is claimed is:

1. A fence panel for tracking a sloped grade of a portion of a terrain surface for attaching to adjacent ones of the fence panel to define an elongate length of fencing along the terrain surface, comprising:

a first rail and a second rail disposed in parallel, spaced-apart relation to each other and defining a longitudinal length of the fence panel, each of said first rail and second rail defining on a side a first longitudinal edge and an opposing second longitudinal edge spaced apart relative to the first longitudinal edge, and said first and second rails disposed at an angle relative to horizontal;

a pair of spaced-apart first pickets disposed substantially perpendicular to horizontal on the side of the first rail and the second rail and attached thereto by a weld only between each of the first pickets and the respective first longitudinal edge of the first rail and the second rail;

a plurality of second pickets disposed substantially perpendicular to horizontal on the side of the first rail and the second rail and attached thereto by a weld only between each of the second pickets and the respective second longitudinal edge of the first rail and the second rail, whereby the first pickets and the second pickets attached on opposing longitudinal edges of the first rail and the second rail restrict the first and second rails from rolling away from the first and second pickets while the fence panel, being racked by moving opposing ends of the panel in opposing vertical directions relative to the terrain surface, conforms a slope of the first rail and the second rail substantially to a slope of the portion of the terrain surface by changing the angle between the first and second pickets relative to the first and second rails while the first and second pickets remain substantially perpendicular to horizontal.

2. The fence panel as recited in claim 1, further comprising a pair of end posts attached to opposing ends of the first and second rails and extending sufficiently in a first direction for seating a portion thereof in the terrain surface, whereby a fence panel stands in an installed position relative to the terrain surface.

3. The fence panel as recited in claim 2, further comprising:

angle members, each having a first and a second leg, the first leg of each angle member attached to a distal end of one of the first and second rails and the second leg defining a pair of holes;

screws extending through the holes to secure the rails to a respective one of the fence posts.

4. The fence panel as recited in claim 1, wherein the fence panel is selectively racked during installation between about 0 and 20 degrees relative to the angle at which the first and second rails are disposed when the first and second rails and the first and second pickets are initially attached together.

5. The fence panel as recited in claim 1, wherein the angle at which the first and second rails are disposed is between about 0 degrees and 60 degrees.

6. The fence panel as recited in claim 5, wherein the fence panel is selectively racked during installation between about 0 and 20 degrees relative to the angle at which the first and second rails are disposed when the first and second rails and the first and second pickets are initially attached together.

7. The fence panel as recited in claim 1, wherein the angle at which the first and second rails are disposed is selected from the group comprising the angles of about 0 degrees, about 20 degrees, about 40 degrees, and about 60 degrees.

8. The fence panel as recited in claim 7, wherein the fence panel is selectively racked during installation between about 0 and 20 degrees relative to the angle at which the first and second rails are disposed when the first and second rails and the first and second pickets are initially attached together.

9. The fence panel as recited in claim 1, wherein the rails are four-wall tubular members.

10. The fence panel as recited in claim 1, further comprising angle members, each having a first and a second leg, the first leg of each angle member attached to a distal end of one of the first and second rails and the second leg defining a pair of holes for receiving screws for attaching to a fence post.

11. A fence panel readily adjustable to track substantially a slope of a terrain during installation thereof, comprising:

a pair of elongate rails disposed in parallel spaced-apart relation and at an angle relative to horizontal to define a longitudinal length of a fence panel, the rails each defining on a side opposing first and second side edges;

a plurality of first pickets and a pair of second pickets disposed on the side of the rails perpendicular to horizontal, the first pickets attached to the rails by fasteners only between the first pickets and the first side edge of the respective rail, and the second pickets attached to the rails by fasteners only between the second pickets and the opposing second side edge of the respective rail, whereby the opposing attachment of the first and second pickets to the rails restricts the rails from rolling away from the first and second pickets while the fence panel during installation in a fence over a terrain adjusts to a slope of a portion of the terrain by moving opposing ends of the fence panel in opposing directions transverse to the longitudinal axis of the rails while the pickets remain substantially perpendicular to horizontal.

12. The fence panel as recited in claim 11, wherein the fasteners comprise flexible mild steel welds.

13. The fence panel as recited in claim 12, wherein the angle at which the rails are disposed is between about 0 degrees and 60 degrees.

14. The fence panel as recited in claim 13, wherein the fence panel is selectively racked during installation between about 0 and 20 degrees relative to the angle at which the rails are disposed when the rails and pickets are initially attached together.

15. The fence panel as recited in claim 14, further comprising a pair of end posts attached to opposing ends of the rails, whereby adjacent fence panels connect to the end posts to define a longitudinal section of a fence.

16. The fence panel as recited in claim 15, further comprising;

angle members, each having a first and a second leg, the first leg of each member attached to a distal end of one of the rails and the second leg defining a pair of holes;

screws extending through the holes to secure the rails to a respective one of the fence posts.

17. The fence panel as recited in claim 15, wherein the rails are four-wall tubular members.

18. A method of making a fence section for tracking a sloped grade during installation of a fence over a terrain, comprising the steps of:

(a) disposing a pair of rails parallel and spaced-apart at an angle to a horizontal plane to define a longitudinal length of a fence panel, the rails defining opposing first and second side edges relative to the horizontal plane;

(b) attaching a plurality of first pickets to a side of the rails disposed substantially perpendicular to the horizontal plane with fasteners only between the first pickets and the first side edge of the rails; and (c) attaching at least two second pickets to the side of the rails and disposed substantially perpendicular to the horizontal plane by fasteners only between the second pickets and the opposing second side edge of the rails, whereby the attachment of the first pickets to the rails opposing the attachment of the second pickets to the rails, restrict the rails from rolling away from the first and second pickets while racking the fence section by moving opposing ends of the fence section in opposing directions transverse to the longitudinal axis of the rails to conform a slope of the rails substantially to a slope of a portion of the terrain by changing the angle between the first and second pickets relative to the rails while the first and second pickets remain substantially perpendicular to the horizontal plane.

* * * * *